United States Patent [19]

Sparks

[11] 4,412,754

[45] Nov. 1, 1983

[54] SPACE BAR FOR LOW PROFILE KEYBOARDS

[75] Inventor: Daniel R. Sparks, Temple City, Calif.

[73] Assignee: Becton Dickinson and Company, Paramus, N.J.

[21] Appl. No.: 421,742

[22] Filed: Sep. 23, 1982

[51] Int. Cl.[3] ..... B41J 5/08

[52] U.S. Cl. ..... 400/496; 400/495.1

[58] Field of Search ..... 400/496, 490, 495, 495.1

[56] References Cited

U.S. PATENT DOCUMENTS

| | | | |
|---|---|---|---|
| 3,292,761 | 12/1966 | Erpel | 400/496 |
| 3,720,801 | 3/1973 | Yanaga | 400/496 X |
| 3,750,113 | 7/1973 | Cencel . | |
| 3,771,636 | 11/1973 | Kerns, Jr. | 400/496 |
| 4,010,838 | 3/1977 | Sims, Jr. | 400/496 |
| 4,090,229 | 5/1978 | Cencel et al. . | |
| 4,300,029 | 11/1981 | Master . | |
| 4,307,268 | 12/1981 | Harper . | |
| 4,384,796 | 5/1983 | Denley | 400/496 |

OTHER PUBLICATIONS

Cassell, J. N., "Space Bar Mounting," IBM Technical Disclosure Bulletin, vol. 9, No. 12, May 1967; p. 1773.

*Primary Examiner*—Clifford D. Crowder

[57] ABSTRACT

A space bar construction is provided for low profile keyboards which will accommodate, with the same construction, from a 1 to 3 space bar up to a 1 to 9 space bar. The arrangement provides a leveling system for the space bar to maintain exactly equal the depressed distances of the space bar at each end thereof through the utilization of a torsion spring for the leveling wire. The torsion spring imparts a constant loading in the leveling wire, and consequently the key top to avoid any noisy "play" between the parts. The unit is assembled complete as a self-contained module for later insertion into a low profile keyboard.

7 Claims, 10 Drawing Figures

SPACE BAR FOR LOW PROFILE KEYBOARDS

BACKGROUND AND STATEMENT OF THE INVENTION

The present invention relates generally to capacitive keys for use in keyboards, and particularly to space bars for use in low profile keyboards. The arrangement is such that a self-contained module is provided which may accommodate a 1 by 3 up to a 1 by 9 space bar, which module after assembly may be subsequently inserted into the keyboard, as required.

This invention relates also, to co-pending U.S. application Ser. No. 349,349 filed Feb. 16, 1982 and entitled Low Profile Keyboard Switch, which application is incorporated herein, by reference, in its entirety. In that application, a self-contained key switch module is disclosed which provides an extraordinarily low profile keyboard for capacitive keys with the keyboard switch having a substantially reduced overall height of 0.75 inches (19.05 mm) while still maintaining a length of travel of 0.15 inches (3.81 mm). The construction taught in that application eliminates the need for any housing for the switch assembly of the key switch unit by providing a combination assembly supported directly on the printed circuit board. The parts of the assembly are snap-fitted together, eliminating the need for hardware such as screws or nuts for connecting the parts.

This invention is an improvement over the assembly taught therein for use when space bars are required. The module of the invention here is a space bar unit which may be snap-fitted into a capacitive keyboard in the same manner as the single unit assembly of that co-pending application Ser. No. 349,349.

The space bar construction of the invention here provides a leveling system for space bars so that both ends of the space bar go down exactly at the same time. This is achieved by utilizing a torsion spring for the leveling wire which extends between each end of the space bar. With such a construction, pressure is always applied to the leveling wire, which eliminates noise in a loosely mounted wire as used previously.

One of the problems involved with prior art arrangements is the fact that the leveling wire extending between two independent plungers for manipulating the space bar must have mechanical tolerance between each of the plungers. This loose fit between the plungers and the leveling wire allows the leveling wire to rattle creating an objectionable noise. The new arrangement herein minimizes noise since the leveling wire is always preloaded against the plungers by the torsion spring.

With the foregoing and additional objects in view, this invention will now be described in more detail, and other objects and advantages thereof will be apparent from the following description, the accompanying drawings and the appended claims.

DETAILED DESCRIPTION OF THE INVENTION

Figure 1:
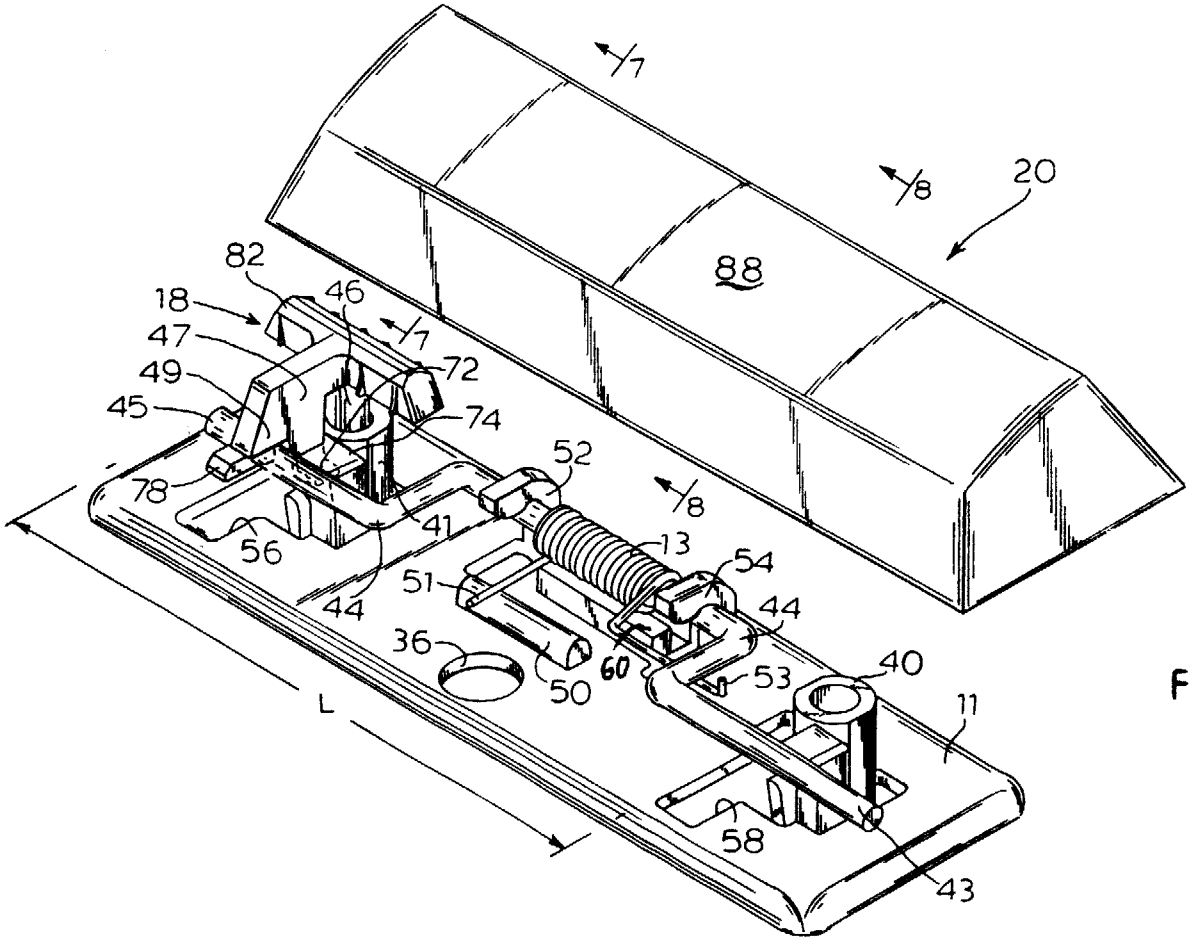
FIG. 1 is a perspective view of a low profile capacitive space bar switch assembly illustrating the invention.

Referring to the drawings in which like reference characters refer to like parts throughout the several views thereof, FIG. 1 shows a perspective view of a space bar module illustrating the invention with such space bar module being arranged to be snap-fit into the printed circuit board of a low profile keyboard assembly as described in the above noted U.S. application Ser. No. 349,349. Thus the module of the invention may be press fit into a low profile keyboard according to the invention taught in that application wherein a printed circuit is developed in a copper sheet laminated or deposited onto the lower surface of the printed circuit board of fiberglass or other electrically non-conducting material.

Thus, an elongated base support 11 is shown having spaced apart annular integral guides 40,41 for receiving in reciprocal relation therein plungers 46 depending from plunger bodies 18. As will be understood, there is a plunger body 18 reciprocally mounted in guide 40 in the same manner as is the one shown in guide 41 in FIG. 1. The plunger body has been removed for clarity in the figure. At any rate, each plunger body 18 includes an integral rear extension 47 extending from plunger body cross-member 82 in T-shaped fashion. The rear extension 47 includes a hook-like portion 49 which extends over one end 45 of leveling wire 44. The end 45 of leveling wire 44 rests on an integral extension 78 of plunger body module 18. Also extending from the rearward extension 47 of plunger body module 18 is a hook 72 which cooperates with an opposed hook 74 integral with the support base 11 to limit the upward movement of plunger body module 18.

As can be seen further in FIG. 1, leveling wire 44 extends under two spaced apart hooks 52, 54 which form part of the support assembly for leveling wire 44. Also mounted on leveling wire 44 between hooks 52, 54 is a tension spring 13 one end 51 of which rests on a support 50 which is integral with base support 11 and the other end 53 of which is against leveling wire 44 to impart a constant upward pre-loading to leveling wire 44. Leveling wire 44, in turn, constantly urges spaced apart plunger bodies 18 upward to maintain opposed hooks 72, 74 into engagement.

The central portion of leveling wire 44, with spring 13 thereon, rests on lower spaced apart supports 60 (FIG. 3) which are also integral with base support 11. Positioned on the top of the spaced apart plunger bodies 18 is a key top 20 the construction details of which will be described below. Base support 11 includes spaced apart openings 56, 58 which facilitates the molding of the integral base support with spaced apart guide bodies, and the assembly of the module with leveling wire 44 as shown in FIG. 1. The annular opening 36 serves to receive the switch activation stem 53 which depends from and is integral with the key top assembly 20, as will be described in further detail below.

In considering generally the dimensions of space bars, in accordance with this invention, the length L shown in FIG. 1 may be 1.5 inches (38.1 mm.) for a 1 to 3 space bar, and 5.15 inches (192.78 mm.) for a 1 to 9 space bar, for example.

Figure 2A:
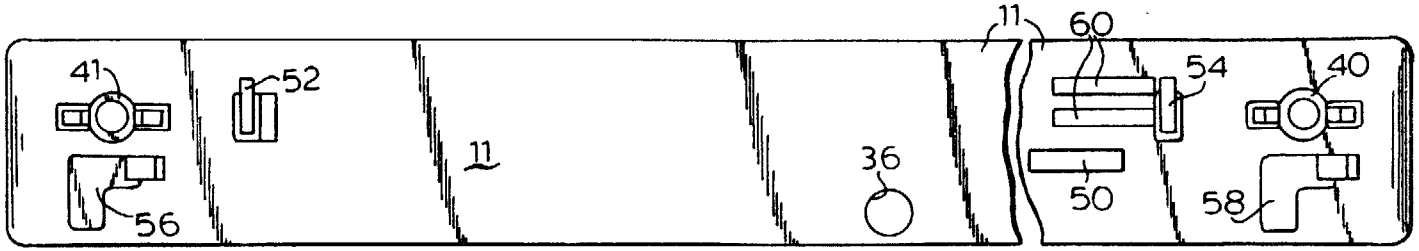
FIGS. 2*a*, 2*b* and 2*c* are a top plan view, a side elevational view, and a bottom plan view, respectively of the base support of a module assembly illustrating the invention.

Referring to FIG. 2*a*, a top plan view of base support 11 is shown. This view shows the relative positioning of the spaced apart guide bodies 40, 41 and the spaced apart support hooks 52, 54 for the leveling wire 44. As can be seen in FIG. 2*a*, the hooks 52, 54 are spaced further apart for accommodating a space bar greater in length than that shown in the perspective view of FIG. 1. It will be understood that the shorter the assembly and the desired space bar module the shorter the spacing between support hooks 52 and 54.

Figure 2B:
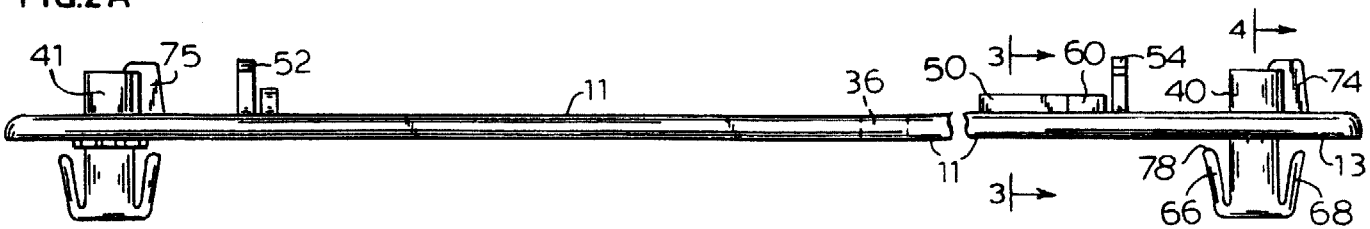

Referring now to FIG. 2*b*, a side elevational view of the base support 11 of FIG. 2*a* is shown. In this view, the depending portions of integral guide bodies 40, 41 are shown with the integral laterally extending locking arms 66, 68 which flex during insertion for mounting in a printed circuit board. The arms flex into place so that top surfaces 78 thereof engage the bottom surface of the printed circuit board in the same manner as described in the above noted co-pending U.S. application. Thus, the base support assembly 11 is snap-fit onto a printed circuit board in the same manner as the single unit switch assemblies described and claimed in that application.

Figure 2C:
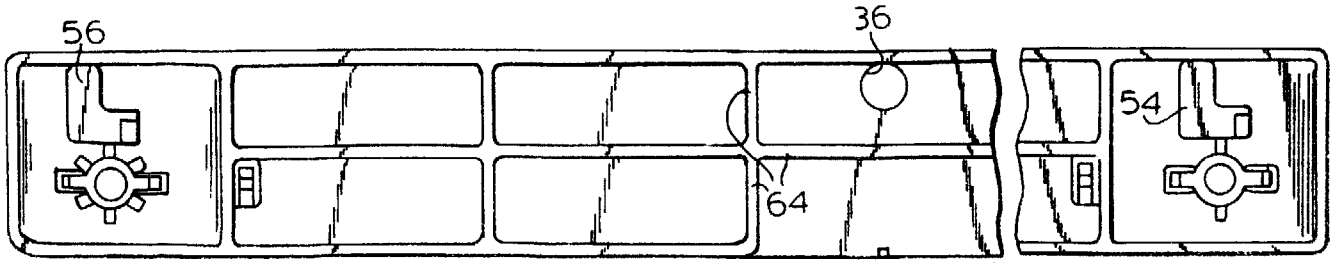

FIG. 2*c* shows the bottom plan view of the base support assembly 11 of FIG. 2*a* with the integral rectangular supporting ribs 64 which provide a degree of rigidity for the base support 11.

Figure 3:
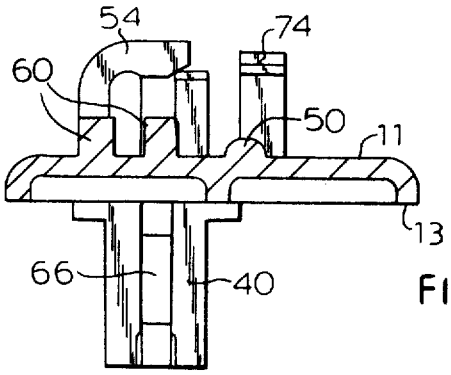
FIG. 3 is a sectional view taken along lines 3—3 of FIG. 2*b*.
Figure 4:
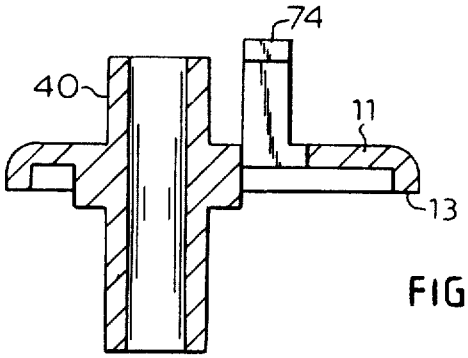
FIG. 4 is a sectional view taken along lines 4—4 of FIG. 2*b*.

Referring now to FIG. 3 a view in section is shown of the integral assembly for supporting the leveling wire including a hook 54 which extends over the top of the leveling wire and the spaced apart upstanding supports 60 which are integral with the base support 11. Spaced apart supports 60 support that portion of the leveling wire which has spring 13 surrounding it. Also shown in FIG. 3 is the elongated integral support 50, again integral with base support 11, for supporting one end 51 of spring 13. Cooperating integral hook 74 which cooperates with the hook 72 on the associated plunger body for limiting the movement of the plunger is also shown. FIG. 4 shows a view in section of integral guide body 40 and its associated hook 74, and the arrangement of the two parts relative to the support base 11.

Figure 5:
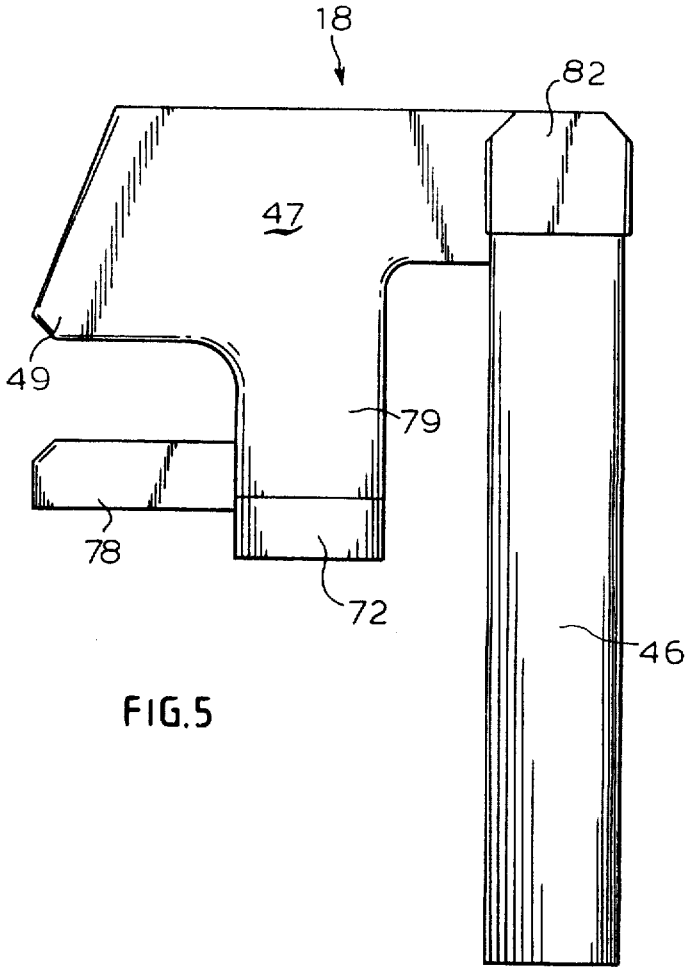
FIG. 5 is a side elevational view of the plunger body part of the module of the invention.
Figure 6:
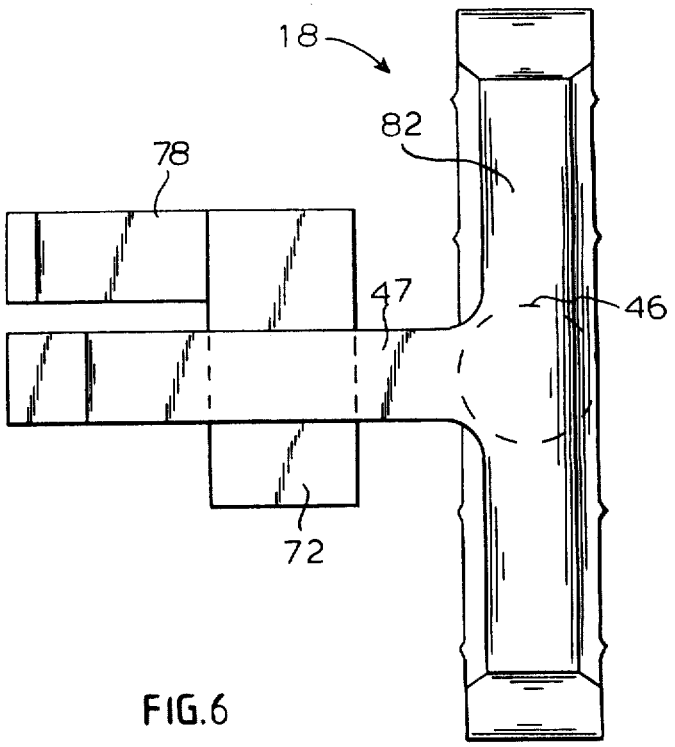
FIG. 6 is a top plan view of the plunger body of FIG. 5.

Referring now to FIG. 5, the plunger body 18 is shown in a side elevational view. The cross-member 82 includes an integral cylindrical plunger 46 which reciprocates in associated guide body 41. Extending rearwardly from the cross-member 82 is the rear extension 47 as described above. Extension 47 includes an integral lower portion 79 which ends in the hook 72 which cooperates with the fixed hook 74 for limiting the upward movement of plunger body 18. The opposing portions 49, 78 on plunger body 18 serve to define a space 80 through which one end 45 of leveling wire 44 extends. FIG. 6 shows the relative positioning of the extensions 47, 78 and hook 72 on the plunger body 18, as well as the positioning of the lower plunger extension 46 shown in dotted line in FIG. 6.

Figure 7:
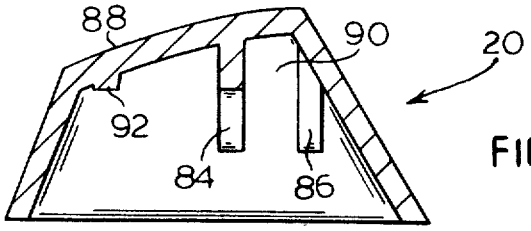
FIG. 7 is a sectional view taken along lines 7—7 of FIG. 1.

Referring now to FIG. 7, a cross-sectional view of the key top 20 is shown. The top surface 88 is angled, as shown in FIG. 7 downwardly toward the rear. An integral abutment 92 engages extension 47. Cross-member 82 of plunger body 18 is received in space 90 defined by depending spaced apart brackets 84, 86. Cross-member 82 of plunger body 18 is received in space 90 in a press fit engagement.

Figure 8:
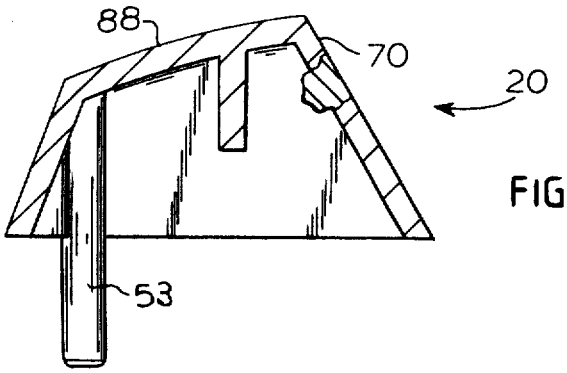
FIG. 8 is a sectional view taken along lines 8—8 of FIG. 1.

Referring now to FIG. 8, an additional sectional view of key top 20 is shown with plunger depending switch activating plunger 52 thereon. Plunger 52 reciprocates through opening 36 in base support 11 for engaging the movable portion of a capacitance switch as described in the above-noted co-pending application, in order to activate the movable portion of the capacitance switch and move it away from the fixed portion thereof.

Thus, there is provided, in accordance with this invention, a simplified space bar construction for low profile keyboards which uses the same assembly to accommodate a 1 to 3 space bar up to as much as a 1 to 9 space bar. The arrangement includes a precise leveling system so as to maintain exactly an equal depression of the space bar at each end thereof through the utilization of a torsion spring in conjunction with the leveling wire. The arrangement is such that the torsion spring maintains the leveling wire against any rattling or noise during the operation thereof. Moreover, the assembled unit is a self-contained module for later snap-fit insertion into a low profile keyboard, as required.

The simplified assembly of the invention eliminates the need for any housing. Therefore, the assembly is extremely inexpensive to produce as compared to prior art arrangements requiring housings for their support. Since all of the parts are assembled into the module without the use of any screws or bolts or other separate connecting items, the space bars of the invention here are highly advantageous commercially because of the simplicity of the assembly thereof. In this connection, the parts of the module herein are comprised of multiple flexible plastic materials which provide the required flexing in order to enable the parts to be snap fit together. The resin materials for the various parts are selected so as to provide a built-in flexible property. One representative material is Delrin, a product of du Pont Corporation which is an acetyl resin. Other representative materials include polyesters, for example.

While the apparatus herein disclosed forms preferred embodiments of this invention, this invention is not limited to that specific apparatus and changes can be made therein without departing from the scope of the invention which is defined in the appended claims.

What is claimed is:

1. Space bar module apparatus for insertion into a low profile keyboard, characterized by (a) an elongated base support having a central opening;

(b) an annular guide body positioned adjacent each end of said base support;

(c) a plunger body positioned over each said guide body;

(d) a plunger on each said support body vertically reciprocable in its respective guide body;

(e) leveling wire means extending between said plunger bodies for moving said plunger bodies in said guide bodies;

(f) cooperating stop means on said base support and each said plunger bar means for limiting the upward movement of said plunger bodies relative to said base support;

(g) resilient means extending between said leveling wire means and said base support for urging said leveling wire means upwardly for continuously engaging said cooperating stop means; and (h) an elongated key top extending between said plunger bodies for moving said plunger bodies downwardly against said resilient means;

(i) an integral elongated switch activation stem extending downwardly from said key top through said central opening for engaging a movable capacitive plate.

2. The apparatus of claim 1, further characterized by (a) each said guide body being integral with said base support.

3. The apparatus of claim 2, further characterized by each said integral guide body including (a) an integral lower portion extending below the lower surface of said base support;

(b) opposed laterally extending flexible locking arms on said integral lower portion; and (c) each of said flexible locking arms having a bearing surface for engaging a guide opening in a keyboard into which said apparatus is to be mounted;

(d) whereby upon passing such a guide opening, said guide arms flex outward for engaging the bottom surface of a keyboard into which said apparatus is to be mounted.

4. The apparatus of claim 1, further characterized by (a) said resilient means is a torsion spring wrapped around the central portion of said leveling wire means.

5. The apparatus of claim 4, further characterized by (a) a first support for said leveling wire means adjacent said torsion spring;

(b) a second support for one end of said torsion spring; and (c) said first and second supports being integral with said base support.

6. The apparatus of claim 1, further characterized by said cooperating stop means including (a) a upwardly facing hook integral with each said plunger body; and (b) an downwardly facing hook integral with said base support.

7. The apparatus of claim 1, further characterized by each said plunger body including (a) a cross member positioned parallel to said key top and configured for snap-fit engaging therewith;

(b) a rear extension integral with said cross member;

(c) said cooperating stop means integral with said rear extension;

(d) opposed leveling wire engaging means on said rear extension defining a space for receiving one end of said leveling wire means; and (e) said plunger positioned centrally of said cross member and integral therewith.

* * * * *